US006427340B1

(12) United States Patent
Cohen

(10) Patent No.: US 6,427,340 B1
(45) Date of Patent: Aug. 6, 2002

(54) PORTABLE KNIFE SHEATH AND METHOD OF USING THE SAME

(76) Inventor: Gregg A. Cohen, 8311 Eastpoint Dr., Bldg. 400, Dallas, TX (US) 75227

( * ) Notice: Subject to any disclaimer, the term of this patent is extended or adjusted under 35 U.S.C. 154(b) by 0 days.

(21) Appl. No.: 09/963,406

(22) Filed: Sep. 27, 2001

(51) Int. Cl.[7] ..... B26B 28/02

(52) U.S. Cl. ..... 30/298.4; 30/151; 224/183; 224/232

(58) Field of Search ..... 30/151, 298.4, 30/296.1, 162; 248/37.3; 224/232, 183, 234; 220/483; 24/67 R; 211/87.01, 70.7

(56) References Cited

U.S. PATENT DOCUMENTS 4,183,439 A * 1/1980 Bell ..... 211/70.7
4,492,028 A * 1/1985 Bourgein ..... 30/298.4
4,942,663 A * 7/1990 Ray, Sr. ..... 30/151
4,984,368 A * 1/1991 Hoover et al. ..... 30/151
5,011,102 A * 4/1991 Kiefer ..... 248/37.3
5,146,684 A * 9/1992 Hagler ..... 30/162
5,211,322 A * 5/1993 Nealy ..... 224/232
5,275,068 A * 1/1994 Wrench ..... 30/296.1
5,425,160 A * 6/1995 Krapf ..... 24/67 R
5,490,607 A * 2/1996 Hsieh et al. ..... 220/483
5,682,653 A * 11/1997 Berglof et al. ..... 224/183
5,820,001 A * 10/1998 Soros ..... 224/234
6,216,888 B1 * 4/2001 Chien ..... 211/87.01

* cited by examiner

*Primary Examiner*—Hwei-Siu Payer

(57) ABSTRACT

The invention provides a portable knife holder having a mounting plate embedded with at least one magnet for holding a knife on a top surface of the mounting plate, and a strap attached to the mounting plate for mounting the mounting plate to a user or to an object.

16 Claims, 5 Drawing Sheets

PORTABLE KNIFE SHEATH AND METHOD OF USING THE SAME

BACKGROUND OF THE INVENTION

1. Field of the Invention

The invention generally relates to a portable knife holder having a mounting plate embedded with at least one magnet for holding a knife on a top surface of the sheath. In particular, a strap is attached to the mounting plate for mounting the mounting plate to a moving object or a user.

2. Description of Related Arts

Currently, there are numerous examples for a sheath made of plastic or metal for storing a knife while not in use. U.S. Pat. No. 5,979,673 to Dooley teaches a magnetic cooking utensil holder which allows a user to temporarily secure hot pan lids to avoid placing the hot and sometimes soiled lids on a counter top. The holder is designed mainly for a pan lid rather than a knife so that it is bulky and stationary on a flat surface. U.S. Pat. No. 5,011,102 to Kiefer discloses a magnetic knife holder (see FIG. 8) with magnets 23 covered top and bottom by a cowling 11 which has a curved entry 13 to "clamp" the knife 10 to the magnets 23 which are mounted on a magnetic strap 14 as shown in FIG. 6. However, it takes time to aim a knife at the curved entry, and the magnetic knife holder is heavy to carry around outdoors.

When a hunter, a fisherman, or a butcher is skinning or cutting the carcass of an animal, the task is to remove the skin, and separate sections of meat away from the carcass with a sharp knife in a safe and sanitized manner. The task entails continuous repositioning of an animal that could weigh hundreds of pounds: a two handed task. If an user uses any traditional sheath while cutting and adjusting the position of a subject carcass, it would be difficult for the user to clean or move around the sheath. What does the user do with the knife when the user has to handle the carcass with both hands? Most commonly, the knife often heavily soiled is stabbed back in the sheath directly, which can contaminate the sheath and make it irreparably dirty. It is also common for the user to lay the knife on the ground, which can get caught up in the animal parts, or get turned around with the blade facing a different direction than originally placed, or simply get lost. Additionally, it is common to stab the knife into the ground which can only further contaminate and dull the blade.

Currently, there is no portable knife holder facilitating easy and convenient use while the user is working and moving around, especially outdoors.

SUMMARY OF THE INVENTION

It is a purpose of this invention to provide a portable and hands-free knife holder for holding a soiled knife easily and safely while the user is working and moving around.

It is another purpose of this invention to allow an outdoor user to carry a soiled knife easily and safely while the user is working and moving around.

It is still another purpose of this invention to provide a portable and hands-free knife holder that has very few parts, is easy to make, and is easy to clean and maintain.

DESCRIPTION OF THE DRAWINGS

The foregoing and additional features and characteristics of the present invention will become more apparent from the following detailed description considered with reference to the accompanying drawings in which like reference numerals designate like elements and wherein.

DESCRIPTION OF THE PREFERRED EMBODIMENTS

Figure 1A:
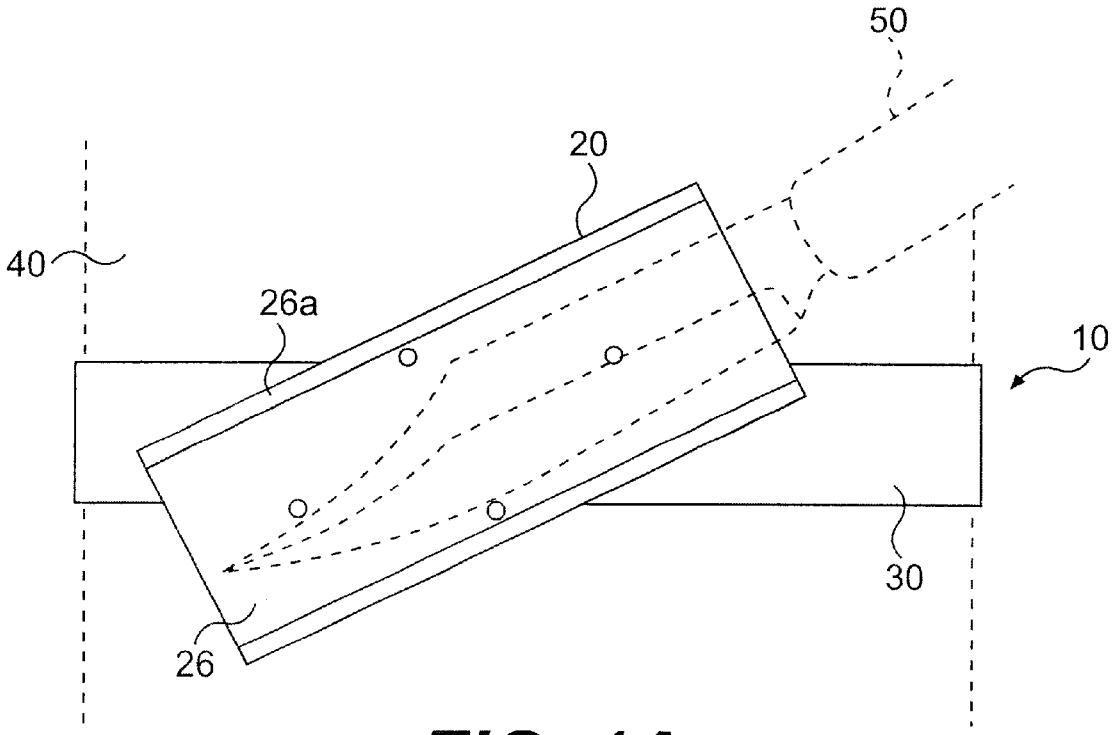
FIG. 1A is a schematic diagram of a first embodiment of the invention as it is worn on a leg and holding a knife, with FIG. 1B showing a variation thereof.

Referring to the FIG. 1A, a knife 50 (in broken outline) is placed on a mounting plate 20 of the knife holder 10. The mounting plate 20 is attached to a mounting strap 30 so as to fasten onto a human leg 40 (in broken line). The mounting plate 20 is mounted to the mounting strap 30 at a 45 degree angle suitable for left or right handed people.

Figure 1B:
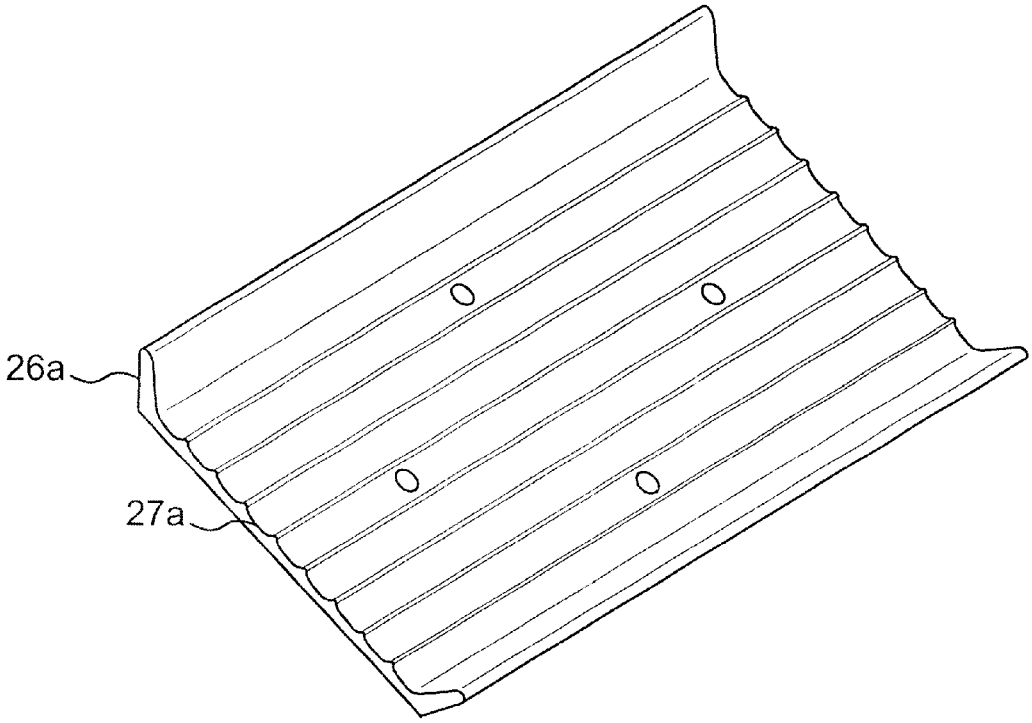

The mounting plate has a non-slip surface 26 made of rubber or other synthetic resin material that has beveled sides 26*a* so that the knife 50 rests within a range of bevels even if it pivots rather than the blade tip leaving the surface area. The surface 26 may also have a texture or slits/grooves 27 to allow the blood to drain so as to insure a continuous grip (see FIG. 1B).

Figure 2:
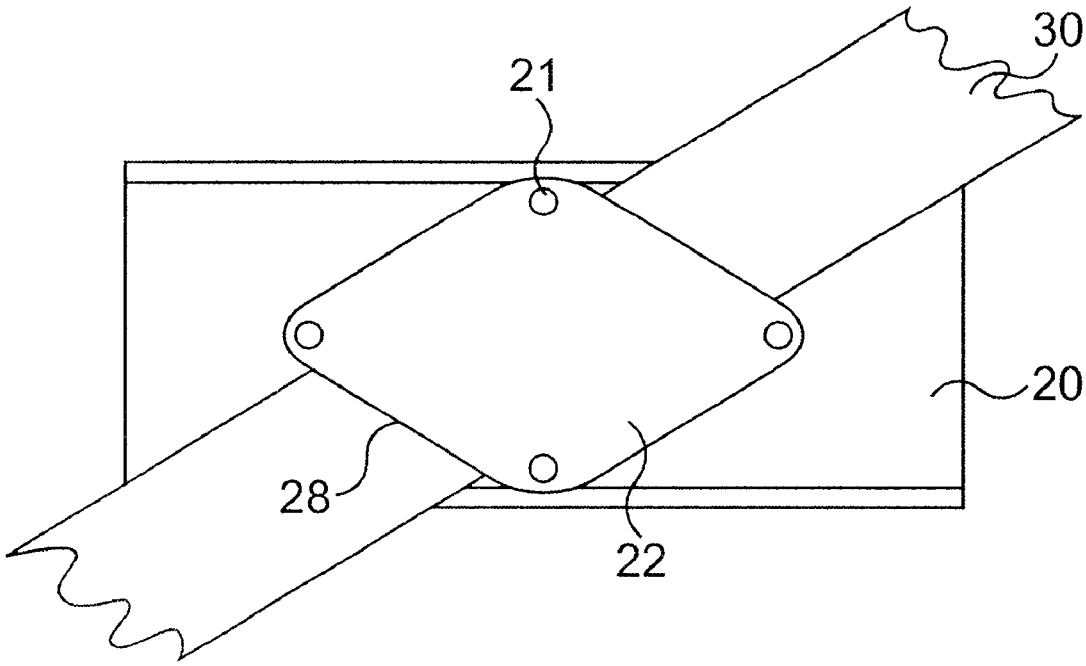
FIG. 2 is a rear view of the embodiment of the invention shown in FIG. 1.

The mounting plate 20 shown in rear view in FIG. 2 has four buckles or bolts 21 which fasten a diamond-shaped leather backing 22 to the mounting plate 20 to form a slit 28 for inserting the mounting strap 30 underneath the diamond-shaped leather 22 so as to attach the mounting plate 20 to another object. The mounting strap 30 is a 1.5 inch×24 inch piece of elastic material, such as Spandex®, with 1.5 inch×6 inch hook-and-loop tabs 31 (see FIG. 3), such as Velcro®, at its ends for adhesion. Hook-and-loop surfaces facilitate any desired angle which enables the user to mount the knife holder to a work surface, a human arm, wrist, or leg.

Figure 3:
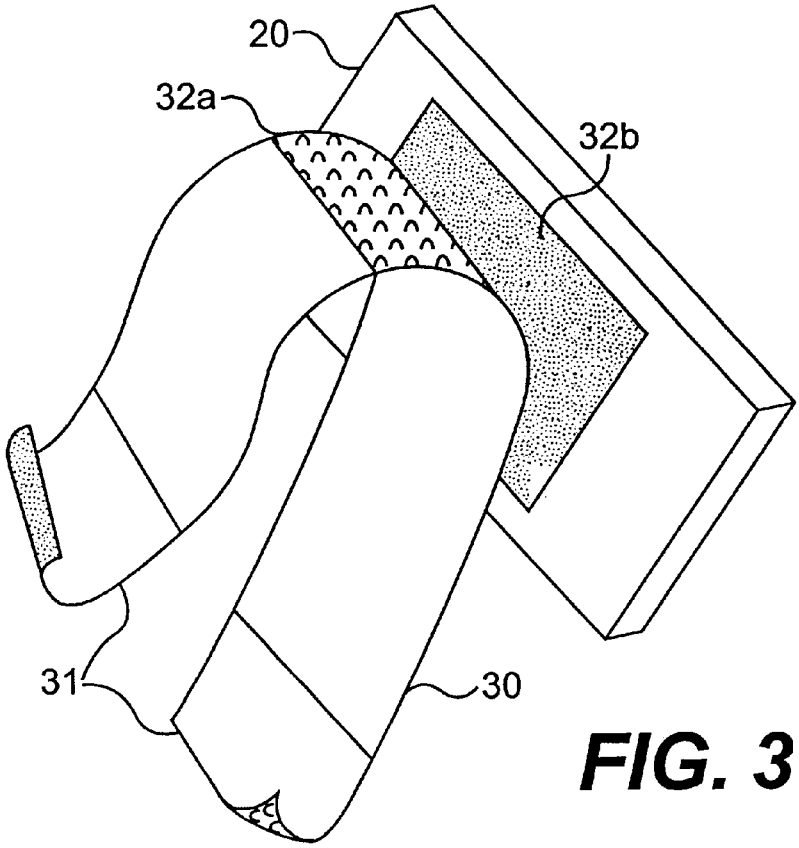
FIG. 3 shows a second embodiment of the invention.

In an other embodiment as shown in FIG. 3, rather than the diamond-shaped leather backing 22 on the back of the mounting plate 20 for a knife to slip through, one side of a pair of hook-and-loop surfaces 32*a* covers the back of the mounting strap 30 and another strip made from the corresponding side of the pair of hook-and-lop surfaces 32*b* is in the middle of the mounting plate 20, which allows the user to mount the plate 20 to the mounting strap 30 at any selected angle. Since the hook-and-loop surfaces do not stretch as much a leather, it gives more strength to the mounting plate 20.

Figure 4:
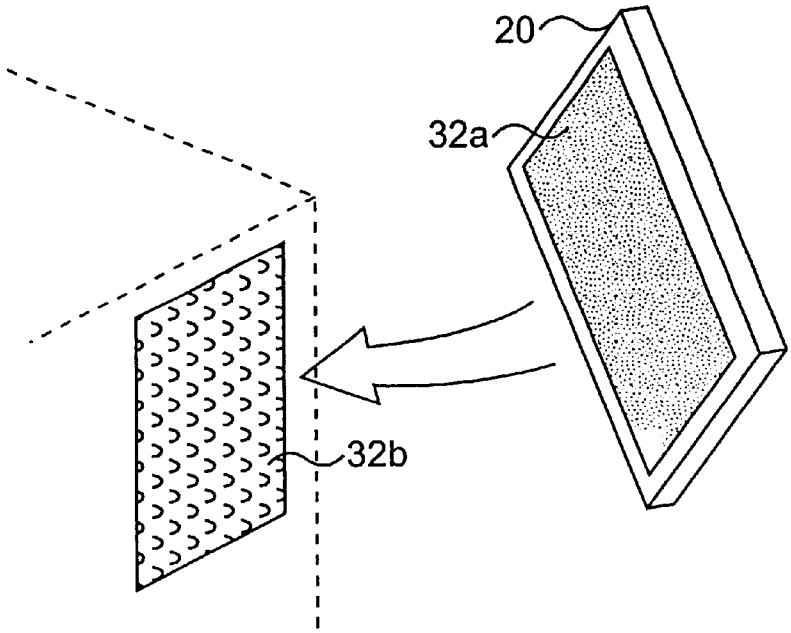
FIG. 4 shows a third embodiment of the invention.

In a third embodiment as shown in FIG. 4, the mounting plate 20 has the rear hook-and-loop surface 32*a* so as to attach the mounting plate 20 directly onto an object having the corresponding hook-and-loop surface 32*b* without the mounting strap 30 or the like.

Figure 5:
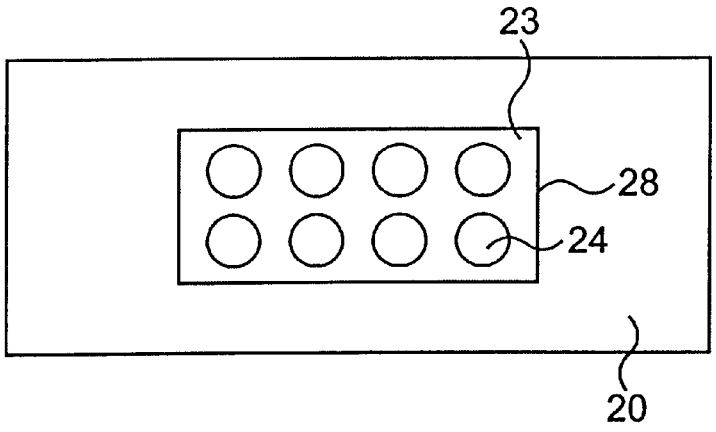
FIG. 5 is a longitudinal vertical section of the mounting plate taken on the magnetic seat of the embodiment of the invention illustrating the magnet assembly mounted on the magnetic seat.
Figure 6:
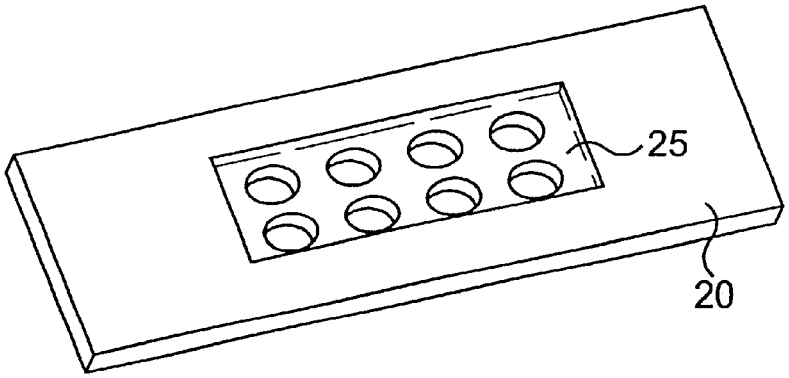
FIG. 6 is a perspective view the mounting plate of FIG. 5 without any magnets mounted on the magnetic seat.

As shown in FIG. 5, eight magnetic disks 24 are spaced evenly and mounted on a plate 23 to form a magnet assembly 28, which then is placed inside a seat 25 preformed in the mounting plate 20 as shown in FIG. 6. A tape (not shown) is used to cover the mounted magnet assembly 28. The tape then is covered underneath the diamond-shaped leather 22. As such, the magnetic force is felt on the non-slip surface 26 of the mounting plate 20. In other words, the magnets are spaced evenly throughout the area covered by the diamond-shaped leather 22.

The knife holder 10 is strapped to one leg, for instance, at a height that would put the knife handle at arm's length so as to free up a hand of the user to work on something else than holding the knife. To mount the knife to the knife holder 10, the user simply has to lower the knife 50 to the knife holder 10 to allow the blade to magnetically attach to the mounting plate 20. When the user is ready to reuse the knife 50, the user should only twist the knife handle slightly, while pulling away the handle from the knife holder 10 to release the blade from the magnetic force. The knife holder 10 can be washed thoroughly after use.

Figure 7:
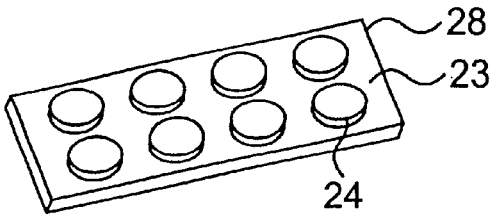
FIG. 7 is a perspective view the magnet assembly of FIG. 5.
Figure 8:
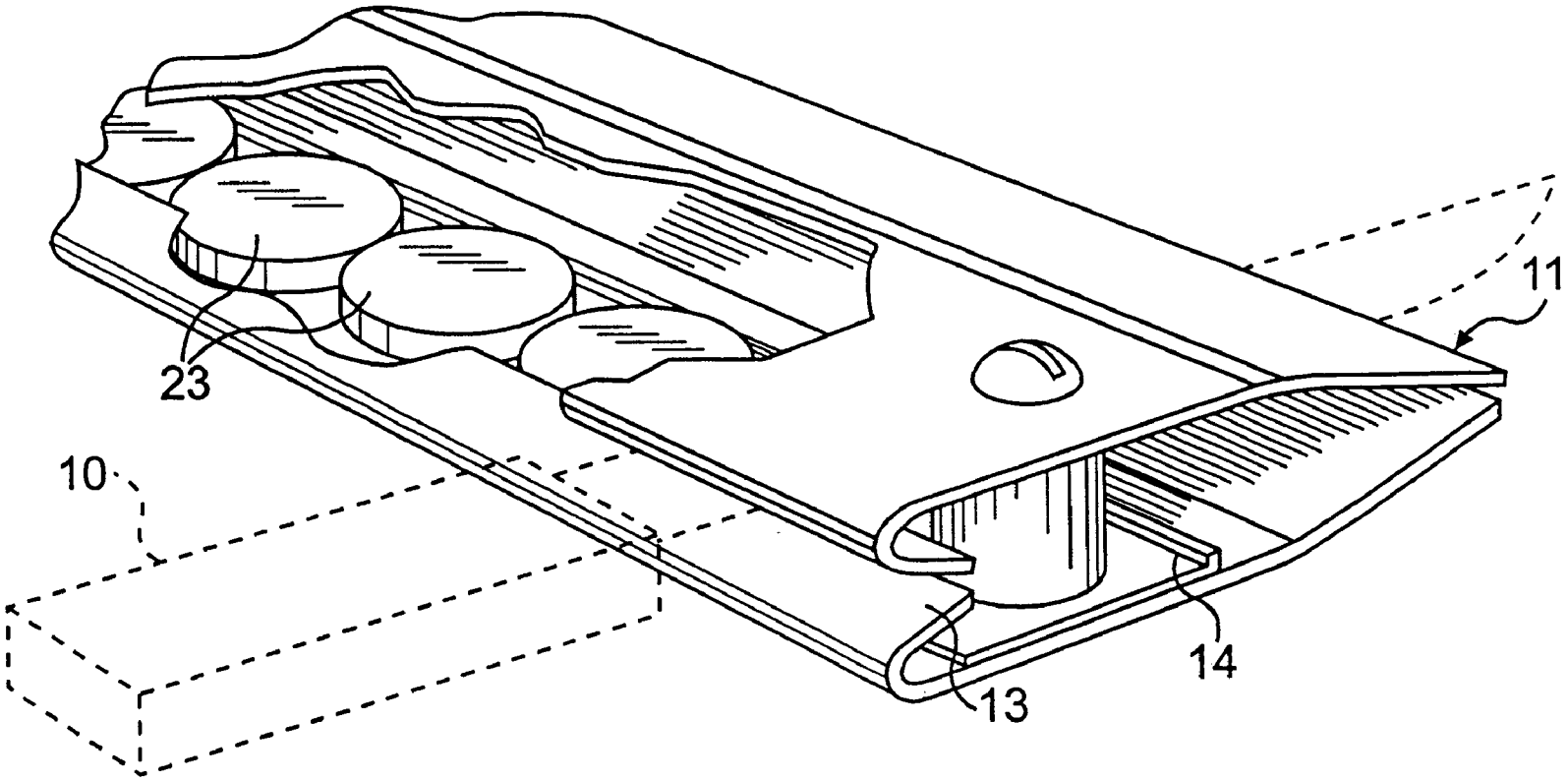
FIG. 8 PRIOR ART
FIG. 8 is an exploded view showing a knife holder of the prior art (U.S. Pat. No. 5,011,102)

The magnets can be in any shape other than a disk, and they can be made from ferrous, ceramic, or similar magnetic material. The magnets can be oriented randomly, but preferably to adjoining magnets with the same polarity. As shown in FIG. 7, the plate 23 that holds the magnets into an assembly is as thin as 1 mm to provide sufficient support without adding too much weight. The thickness of the seat is kept as thin as 1 mm to reduce the gap between the knife 50 and the magnet assembly 28 but still sufficiently support the mounting plate 20. The plate 23 can be made of aluminum, but preferably non-ferrous sheet metal and non-magnetic stainless steel.

The mounting plate 20 and the mounting strap 30 are made of an elastic and light material, such as rubber or plastic, so as to attach the knife holder to objects of different sizes. The knife holder of the invention has very few parts so as to be easily assembled and cleaned.

The principles, preferred embodiments and modes of operation of the present invention have been described in the foregoing specification. However, the invention which is intended to be protected is not limited to the particular embodiments disclosed. The embodiments described herein are illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A portable knife holder, comprising:

a mounting plate embedded with at least one magnet for holding a knife on a top surface of the mounting plate; and a strap attached to the mounting plate for mounting the mounting plate to at least one of a user and a stationary object.

2. The portable knife holder according to claim 1, wherein the strap is formed to attach to at least one of an arm, a waist, or a leg of the user.

3. The portable knife holder according to claim 1, wherein said top surface of the mounting plate is non-slip.

4. The portable knife holder according to claim 1, wherein said top surface of the mounting plate has a texture or slits so as to allow fluid to drain from the mounting plate.

5. The portable knife holder according to claim 1, wherein the strap is made of an elastic material and has hook and loop portions, respectively, at opposite ends thereof.

6. The portable knife holder according to claim 1, wherein the mounting plate is mounted to the strap at a 45 degree angle suitable for a user who is left or right handed.

7. The portable knife holder according to claim 1 further comprising at least one of a buckle and an bolt for fastening the mounting plate to the strap.

8. The portable knife holder according to claim 1 wherein said at least one magnet includes a magnet assembly form by a plurality of evenly placed magnets.

9. The portable knife holder according to claim 8 wherein the plurality of evenly placed magnets are oriented with the same polarity.

10. The portable knife holder according to claim 8 wherein the plurality of magnets are joined by a plate.

11. The portable knife holder according to claim 10, wherein the plate is made from non-ferrous sheet metal or non-magnetic stainless steel.

12. The portable knife holder according to claim 1 wherein said at least one magnet is made from ferrous or ceramic magnetic material.

13. The portable knife holder according to claim 1 wherein the strap is made of an elastic and light material so as to attach the knife holder to objects of different sizes.

14. The portable knife holder according to claim 1, wherein a first hook-and-loop surface is attached to the back of the plate and a second corresponding hook-and-loop surface is attached to the strap for attaching the strap to the plate at any selected angle.

15. A portable knife holder, comprising:

a mounting-plate embedded with at least a top magnet for holding a knife on one surface of the mounting plate; and means for attaching the mounting plate to at least one of a user and a stationary object, wherein the attaching means includes the mounting plate having a rear surface on which is attached one of a hook-and-loop portion so as to attach the mounting plate directly on the at least one of a user and a stationary object having the other of a hook-and-loop portion.

16. A method for providing a portable knife holder to a mobile user comprising:

embedding at least one magnet in a mounting plate;

holding a knife on a top surface of the mounting plate; and attaching a strap to the mounting plate for mounting the mounting plate to the mobile user.

* * * * *